US010549331B2

(12) United States Patent
Kurihara et al.

(10) Patent No.: US 10,549,331 B2
(45) Date of Patent: Feb. 4, 2020

(54) PRESS BRAKE

(71) Applicant: AMADA HOLDINGS CO., LTD., Kanagawa (JP)

(72) Inventors: Masaki Kurihara, Kanagawa (JP); Masahiro Nishiyama, Kanagawa (JP)

(73) Assignee: AMADA HOLDINGS CO., LTD., Kanagawa (JP)

( * ) Notice: Subject to any disclaimer, the term of this patent is extended or adjusted under 35 U.S.C. 154(b) by 311 days.

(21) Appl. No.: 15/119,557

(22) PCT Filed: Feb. 12, 2015

(86) PCT No.: PCT/JP2015/053732
§ 371 (c)(1),
(2) Date: Aug. 17, 2016

(87) PCT Pub. No.: WO2015/129459
PCT Pub. Date: Sep. 3, 2015

(65) Prior Publication Data

US 2017/0066025 A1 Mar. 9, 2017

(30) Foreign Application Priority Data

Feb. 25, 2014 (JP) ..... 2014-033970

(51) Int. Cl.
*B21D 5/02* (2006.01)

(52) U.S. Cl.
CPC ..... *B21D 5/0272* (2013.01)

(58) Field of Classification Search
CPC ..... B21D 5/0272; B21D 5/02
See application file for complete search history.

(56) References Cited

U.S. PATENT DOCUMENTS 5,450,756 A * 9/1995 Kirii ..... B21D 24/08 73/825
5,571,040 A * 11/1996 Kawaguchi ..... B23D 59/002 451/11

(Continued)

FOREIGN PATENT DOCUMENTS

JP 5-57353 3/1993
JP 7-24530 1/1995

(Continued)

OTHER PUBLICATIONS

Machine translation of JP 2000-158392, Doujiyou et al., pp. 1-6, translated on Jul. 23, 2018.*

(Continued)

*Primary Examiner* — Teresa M Ekiert
(74) *Attorney, Agent, or Firm* — Greenblum & Bernstein, P.L.C.

(57) ABSTRACT

A press brake has a lower table arranged at lower part of left and right side frames, an upper table arranged at upper part of the side frames and facing the lower table, one of the upper and lower tables serving as a ram to be moved vertically, and left and right vertical driving units arranged on the side frames, respectively, to move the ram vertically. Strain detecting sensors are arranged on inner and outer side faces, respectively, of each of the left and right side frames, to detect strain of the side frames in such a way as to cancel horizontal deflection of the side frames and detect vertical deflection thereof.

5 Claims, 5 Drawing Sheets

(56) References Cited

U.S. PATENT DOCUMENTS

| | | | | |
|---|---|---|---|---|
| 8,464,591 | B2 * | 6/2013 | Kuwayama | B21D 22/22 73/799 |
| 2008/0066520 | A1 * | 3/2008 | Sperrer | B21D 5/0272 72/389.5 |
| 2009/0120151 | A1 | 5/2009 | Kuwayama et al. | |
| 2010/0126361 | A1 | 5/2010 | Fukami et al. | |
| 2010/0251797 | A1 * | 10/2010 | Sperrer | B21D 5/02 72/376 |

FOREIGN PATENT DOCUMENTS

| | | |
|---|---|---|
| JP | 2566345 | 12/1996 |
| JP | 2000-158392 | 6/2000 |
| JP | 2000-246342 | 9/2000 |
| JP | 4293659 | 7/2009 |
| JP | 2010-149178 | 7/2010 |
| JP | 2013-202623 | 10/2013 |
| KR | 10-1317993 | 10/2013 |
| TW | 200734078 | 9/2007 |
| WO | 2007/080983 | 7/2007 |

OTHER PUBLICATIONS

International Search Report issued in International Patent Application No. PCT/JP2015/053732, dated Apr. 28, 2015, along with English language translation.
Korean Office Action for KR App. No. 10-2016-7022207 dated Apr. 14, 2017, along with English-language translation thereof.
Chinese Office Action for CN App. No. 201580010201.2 dated Jun. 19, 2017, along with English-language translation thereof.

* cited by examiner

PRESS BRAKE

TECHNICAL FIELD

The present invention relates to a press brake, and particularly, to a press brake provided with a function of correctly detecting an amount of vertical deflection (strain) on left and right side frames of the press brake.

BACKGROUND ART

As is well known, a press brake has an upper table at upper part of left and right side frames having a C-gap. To face the upper table in a vertical direction, the press brake has a lower table at lower part of the left and right side frames. A proper one of the upper and lower tables serves as a ram that is movable vertically. To vertically move the ram, the side frames are provided with left and right vertical driving units, respectively. An amount of vertical strain (deflection) on the left and right side frames is detected to compute pressing force applied by the vertical driving units. Based on a result of the computation, the pressing force of the vertical driving units is controlled. Related arts are, for example, Japanese Unexamined Patent Application Publications No. H05-57353 (Patent Literature 1) and No. H07-24530 (Patent Literature 2).

SUMMARY OF INVENTION

Problems to be Solved by Invention

The configuration described in the Patent Literature 1 arranges a bending load detector on an inner side face of the left and right side frames adjacent to the C-gap. More precisely, the bending load detector is arranged at a position where a tangential line of the C-gap is vertical, i.e., a position where deflection to occur is small when the side frames are vertically deflected to open the C-gap. Since the bending load detector is arranged on an inner side face of the side frames, the detector also detects horizontal deflection that occurs when the side frames are horizontally deflected due to, for example, vibration at the time of vertical acceleration or deceleration of the ram. It is difficult for the related art to detect only the vertical deflection of the side frames.

The configuration described in the Patent Literature 2 arranges, as is apparent in FIGS. 2 and 3 thereof, a strain gauge serving as a load detecting unit on a front face of the left and right side frames at the C-gap. The strain gauge is not allowed to be arranged on a curved surface, and therefore, the load detecting unit is arranged on a vertical flat surface at the C-gap. According to the configuration described in the Patent Literature 2, detection by the load detecting unit is little affected by horizontal deflection of the side frames. The load detecting unit, however, is arranged on the vertical flat surface at the C-gap where vertical deflection to occur is small when the side frames are vertically deflected to open the C-gap at the time of, for example, bending a work. Accordingly, this related art is problematic when the vertical deflection caused by load on the side frames must be precisely detected.

Means to Solve Problems

In consideration of the above-mentioned problems, the present invention provides a press brake having a lower table arranged at lower part of left and right side frames, an upper table arranged at upper part of the side frames and facing the lower table, one of the upper and lower tables serving as a ram to be moved vertically, and left and right vertical driving units arranged on the side frames, respectively, to move the ram vertically. The press brake is characterized in that strain detecting sensors are arranged on inner and outer side faces, respectively, of each of the left and right side frames, to detect strain of the side frames.

MODE OF IMPLEMENTING INVENTION

Figure 1:
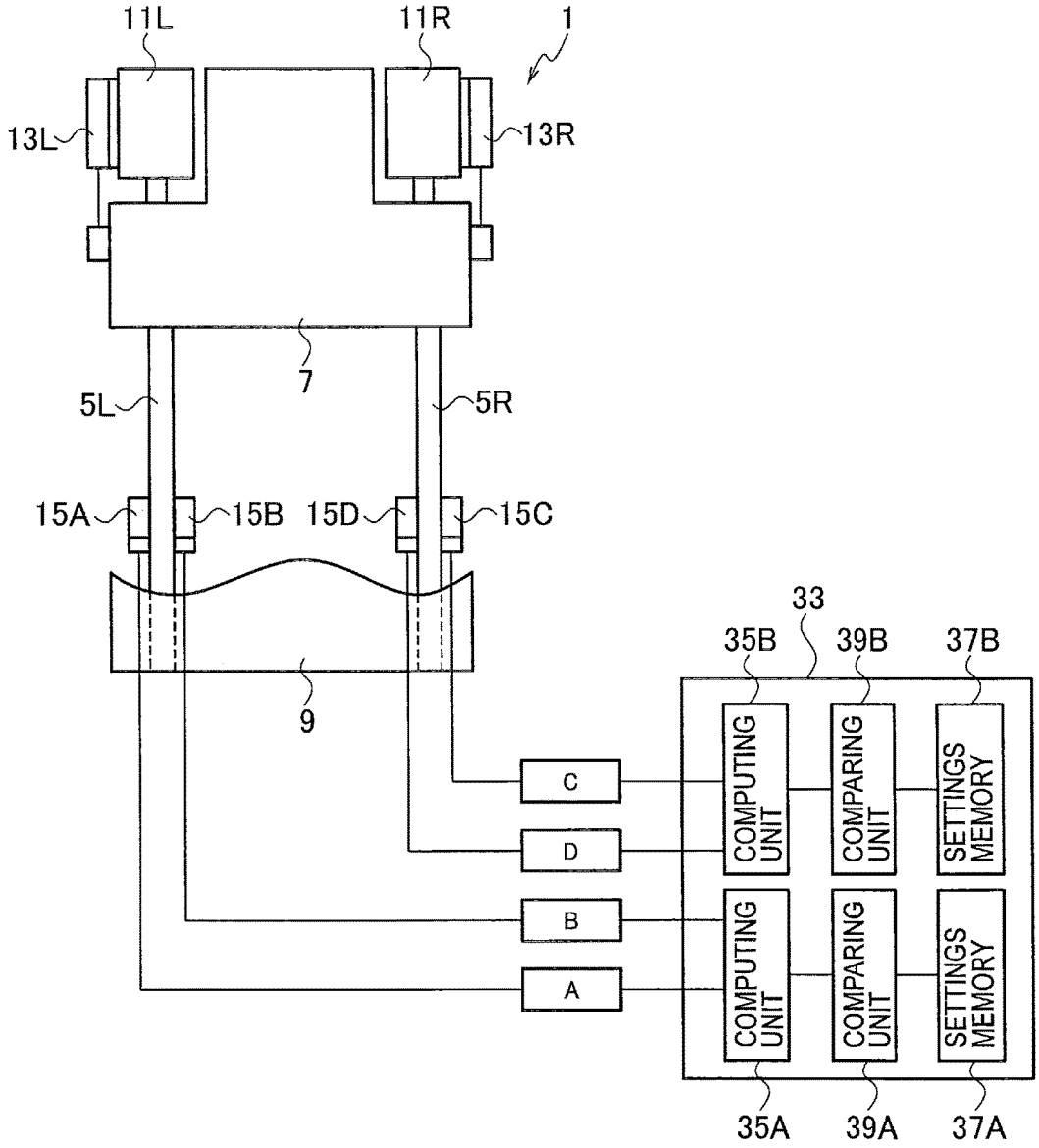
FIG. 1 is an explanatory front view schematically and roughly illustrating a general configuration of a press brake according to an embodiment of the present invention.
Figure 2:
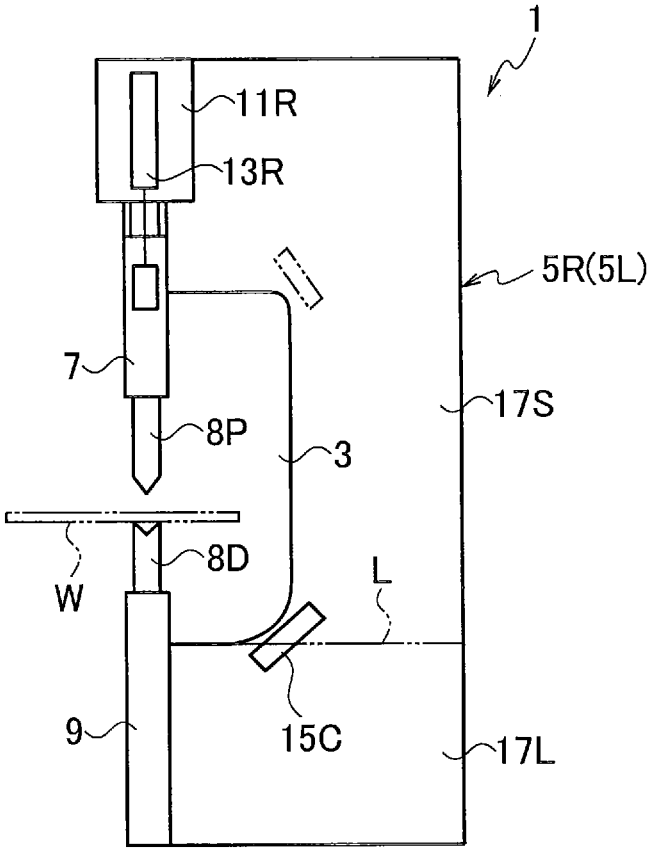
FIG. 2 is an explanatory side view illustrating the press brake.

Referring to FIGS. 1 and 2, a press brake 1 according to an embodiment of the present invention has left and right side frames 5L and 5R that form a C-gap 3. Arranged at upper part of the side frames 5L and 5R is an upper table 7 and arranged at lower part thereof is a lower table 9 that vertically faces the upper table 7. The upper table 7 is moved vertically by way of a ram. To move the ram (upper table 7) vertically, the left and right side frames 5L and 5R have at their upper part left and right vertical driving units 11L and 11R such as hydraulic cylinders or servomotors with ball screw mechanisms. To detect left and right vertical positions of the upper table 7, vertical position detecting units 13L and 13R such as linear sensors are arranged on left and right sides, respectively. The above-mentioned configuration of the press brake is already well known, and therefore, the detailed explanation of a general configuration of the press brake 1 will be omitted.

In the above configuration, upper and lower dies 8P and 8D attached to the upper and lower tables 7 and 9 are driven to bend a plate work W. In order to detect an amount of deflection (strain) of each of the left and right side frames 5L and 5R, outer and inner side faces of the left and right side frames 5L and 5R are provided with strain detecting sensors 15A, 15B, 15C, and 15D, respectively. On the left side frame 5L, the strain detecting sensor 15A attached to the outer side face and the strain detecting sensor 15B attached to the inner side face form a pair. Similarly, the strain detecting sensors 15C and 15D attached to the right side frame 5R are conjugate.

The strain detecting sensors 15A, 15B, 15C, and 15D arranged on the outer and inner side faces of the left and right side frames 5L and 5R are at horizontally symmetrical positions with the left and right side frames 5L and 5R interposed between them. In other words, the outer and inner strain detecting sensors 15A and 15B and 15C and 15D are positioned to face each other in each pair. The strain detecting sensors 15A, 15B, 15C, and 15D are arranged at positions where the side frames 5L and 5R are subject to be deflected when the upper and lower dies press the work.

More precisely, as illustrated in FIG. 2, the strain detecting sensors 15A to 15D each are obliquely positioned so that each virtual plate of the sensors crosses a tangential line L that is horizontally in contact with a lowermost part of the C-gap 3 of the side frames 5L and 5R and so that the rear side (right side in FIG. 2) thereof rises. A lower part 17L that is under the tangential line L of each of the left and right side frames 5L and 5R is a base part where strain is small. An upright part 17S on the tangential line L of the side frame is apt to deform rightward in FIG. 2 when the upper and lower dies 8P and 8D press the work W, to deform the C-gap in an opening direction. The strain detecting sensors 15A, 15B, 15C, and 15D are arranged in the vicinities of positions where the direction of a tangential line of the C-gap 3 sharply changes from horizontal to vertical and where stress tends to concentrate during the pressing work to cause strain on the side frames 5L and 5R. As a result, the sensors are able to precisely detect the amounts of deflection (stress) of the left and right side frames 5L and 5R.

The locations where strain gauges of the strain detecting sensors 15A to 15D are arranged must be flat to detect strain. Such a flat location must have a certain precision flatness. To attach the strain detecting sensors 15A to 15D to the left and right side frames 5L and 5R, the inner and outer side faces of the side frames 5L and 5R may each be cut or ground to form a precision flat measuring area. Forming such a precision flat measuring area on each of the inner and outer side faces of the side frames 5L and 5R is rather difficult, and therefore, the embodiment employs the below-mentioned configuration.

Figure 3:
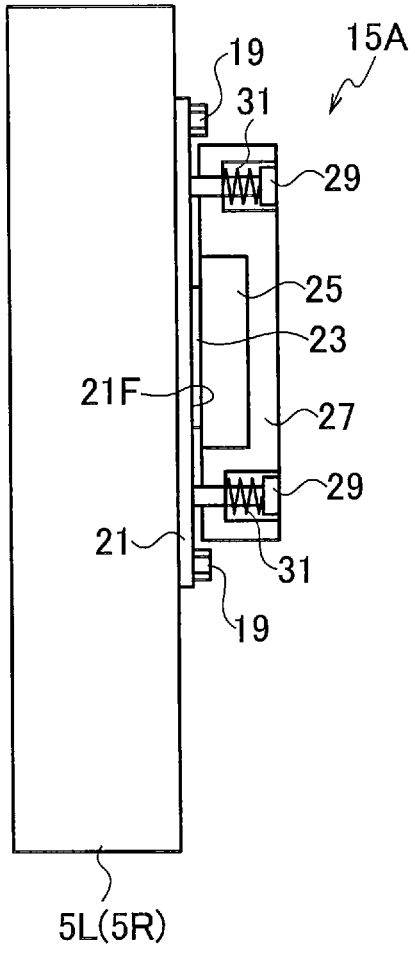
FIG. 3 is an explanatory view illustrating an arrangement of a strain detecting sensor on a side frame.

The strain detecting sensors 15A to 15D each have, as illustrated in FIG. 3, a strain measuring plate 21 that is attachable to the side frames 5L and 5R with a plurality of proper fixtures 19 such as screws. The strain measuring plate 21 is a metal plate made of the same material as the side frames 5L and 5R. A measuring flat surface 21F of the plate 21 is a precision flat plane that is appropriate to press the strain gauge 23 thereto with a preset predetermined pressing force. The strain gauge 23 is held between the measuring flat surface of the strain measuring plate 21 and a support block 25.

The support block 25 is in a recess formed in a biasing member 27, is restricted to move in a direction normal to the plane of the drawing and in a vertical direction, and is biased by the biasing member 27 with a predetermined biasing force. The biasing member 27 is biased by a predetermined pushing force produced by a resilient member 31 such as a coil spring arranged between the biasing member 27 and a fitting bolt 29 that is passed through the biasing member 27 and screwed into the strain measuring plate 21. The strain gauge 23, therefore, is biased toward the measuring flat surface 21F of the strain measuring plate 21 with the set predetermined pushing force applied by the resilient member 31.

As is already understood, the pushing force on the strain gauge 23 toward the measuring flat surface 21F of the strain measuring plate 21 is always constant. The strain measuring plate 21 with the strain gauge 23 biased toward the measuring flat surface 21F is fitted to each of the inner and outer side faces of the side frames 5L and 5R with the fixtures 19. Namely, under the same condition that the strain gauge 23 is biased with the predetermined pushing force toward the measuring surface 21F of the strain measuring plate 21, the strain detecting sensors 15A to 15D are fitted to the side frames 5L and 5R. Namely, the strain detecting sensors 15A to 15D are easily attachable in the same condition to the inner and outer side faces of the left and right side frames 5L and 5R.

The threaded part of each fitting bolt 29 may be elongated so that the fitting bolt 29 is passed through the strain measuring plate 21 and directly fastened to the side frame 5L (5R). In this case, the fixtures 19 are omissible to simplify the structure.

Strain on the side frames 5L and 5R is detected to control outputs from the vertical driving units 11L and 11R. For this, a control unit 33 (refer to FIG. 1) such as a CNC is arranged. The control unit 33 includes an arithmetic unit 35A that adds and averages values A and B detected by the strain detecting sensors 15A and 15B. Namely, it computes "(A+B)/2". Also included is an computing unit 35B for computing an average of values C and D detected by the strain detecting sensors 15C and 15D.

The control unit 33 also includes set value memories 37A and 37B to store preset outputs for the vertical driving units 11L and 11R. Further, the control unit 33 includes comparison units 39A and 39B to compare computed results from the computing units 35A and 35B with the set values in the settings memories 37A and 37B. The comparison units 39A and 39B have functions of comparing computed results from the computing units 35A and 35B with the set values stored in the settings memories 37A and 37B and controlling outputs of the vertical driving units 11L and 11R to be equal to the set values stored in the settings memories 37A and 37B.

With the above-mentioned configuration, the left and right vertical driving units 11L and 11R are driven to press the work W with the upper and lower dies 8P and 8D. Reactive force of the pressing vertically deflects (strains) the side frames 5L and 5R. Amounts of strain on the side frames 5L and 5R are detected by the strain detecting sensors 15A, 15B, 15C, and 15D. According to the detected strain amounts, pressing force by each of the vertical driving units 11L and 11R is computed, to control outputs of the vertical driving units 11L and 11R to required values.

When the vertical driving units 11L and 11R are driven to vertically move the upper table 7, vibration tends to occur during acceleration or deceleration to oscillate the left and right side frames 5L and 5R in left and right directions in FIG. 1. When upper part of the side frames 5L and 5R deflects in the left direction, the outer side face of the side frame 5L tends to contract and the inner side face thereof tends to extend. On the contrary, the outer side face of the side frame 5R extends and the inner side face thereof contracts. Leftward and rightward deflection amounts of the outer and inner side faces of the side frames 5L and 5R are detected by the strain detecting sensors 15A, 15B, 15C, and 15D.

Figure 4:
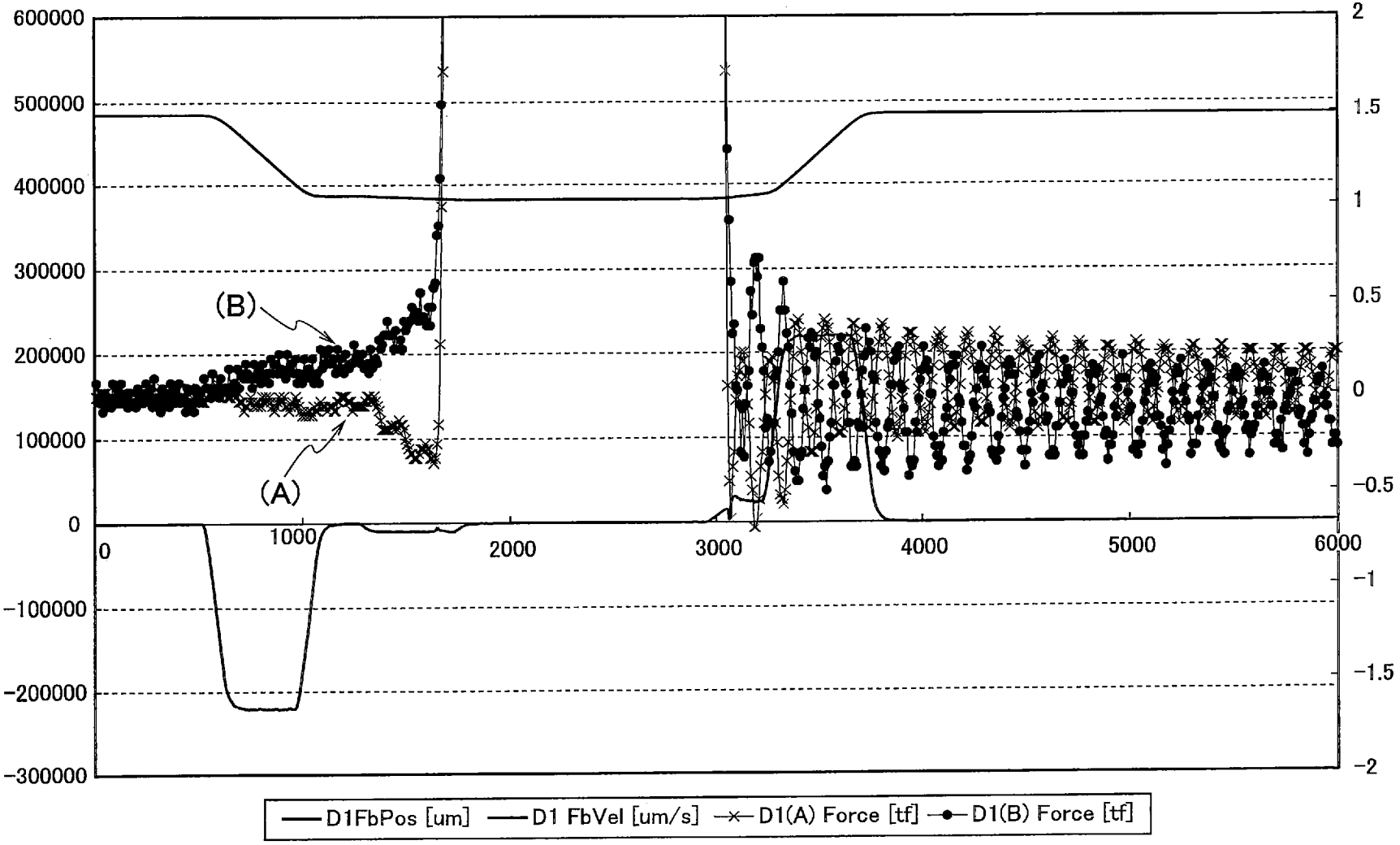
FIG. 4 is an explanatory view illustrating unprocessed outputs from inner and outer strain detecting sensors.
Figure 5:
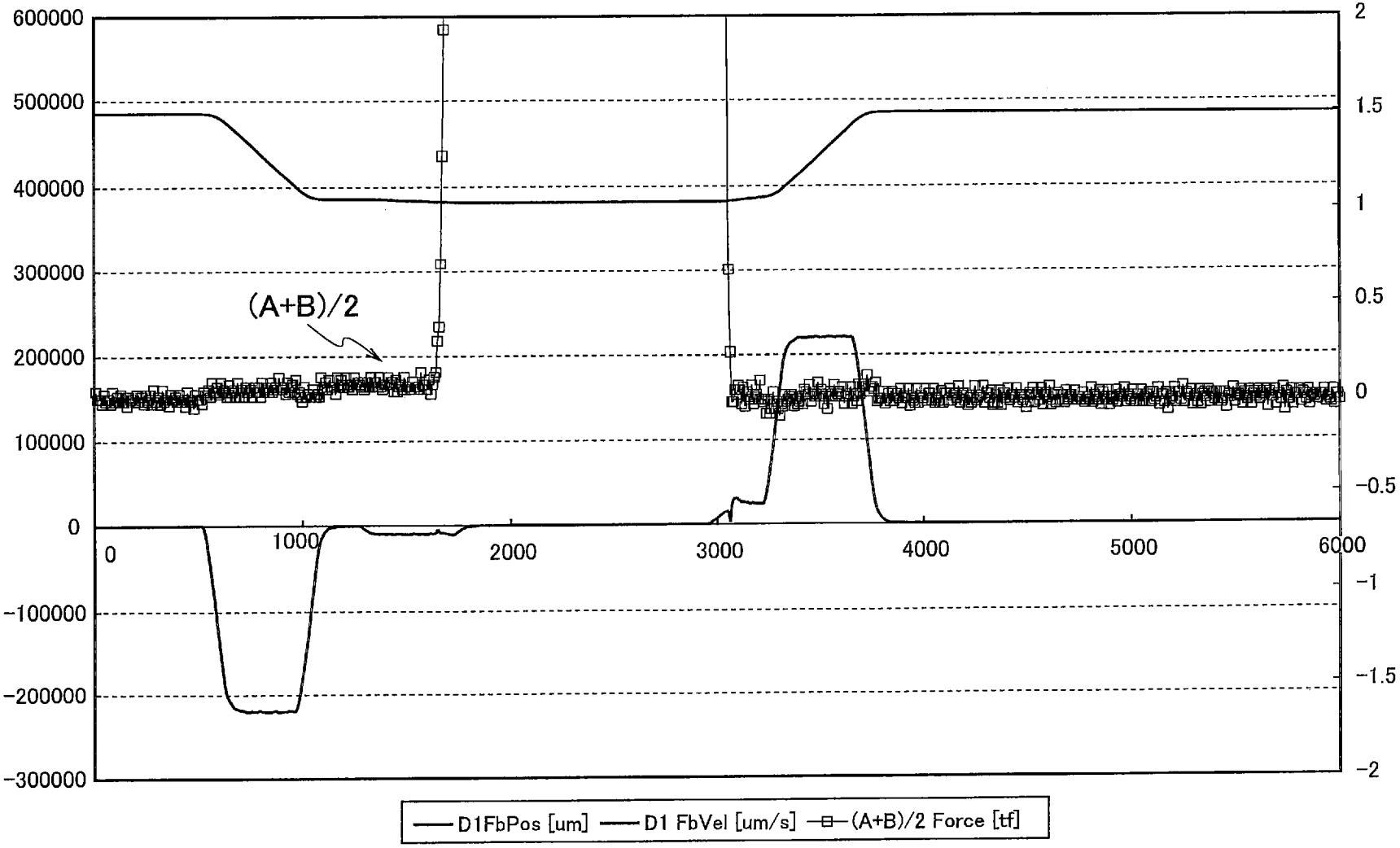
FIG. 5 is an explanatory view illustrating averaged outputs from the inner and outer strain detecting sensors.

According to the configuration that arranges a strain detecting sensor on only one of the outer and inner side faces of the side frames 5L and 5R, only one of the detected values (A) and (B) illustrated in FIG. 4(A) is obtained. This configuration detects a combined state of vertical and horizontal strains on each of the side frames 5L and 5R, and therefore, is unable to correctly detect an amount of strain on the side frames 5L and 5R caused by pressing force during the bending of the work W. Namely, it is difficult for this configuration to correctly control pressing force of the left and right vertical driving units 11L and 11R.

On the other hand, the strain detecting sensors 15A to 15D of the present embodiment is arranged on the inner and outer side faces of the left and right side frames 5L and 5R, and therefore, is able to simultaneously detect contraction and elongation caused by horizontal deflection of the left and right side frames 5L and 5R and compute an average of values detected by the inner and outer strain detecting sensors 15A and 15B as illustrated in FIG. 4(B), thereby, the amounts of vertical strain (deflection) of the left and right side frames 5L and 5R are correctly detected. Consequently, the present embodiment is able to correctly detect vertical deflection amounts of the side frames 5L and 5R caused by pressing force of the vertical driving units 11L and 11R. According to the detected vertical deflection amounts, the present embodiment computes the pressing force of the vertical driving units 11L and 11R, and according to the computed results, correctly controls outputs of the vertical driving units 11L and 11R, thereby realizing precision bending work.

The present invention is not limited to the above-mentioned embodiment. It allows proper modifications to realize other embodiments. For example, locations of the strain detecting sensors 15A to 15D are not limited to those under the C-gap 3. As illustrated with an imaginary line in FIG. 2, they may be arranged above the C-gap 3 in the vicinities of positions where the direction of a tangential line of the C-gap 3 changes from horizontal to vertical. The shape of the C-gap 3 is not limited to the one illustrated in FIG. 2. It may have an optional shape.

According to the present invention, a press brake is provided with strain detecting sensors on inner and outer side faces of left and right side frames of the press brake. When the side frames deflect horizontally, one of the strain detecting sensors that form a pair detects elongation of the corresponding side frame and the other detects contraction of the same. Values detected by the pair of strain detecting sensors are used to cancel the horizontal deflection and detect an amount of vertical deflection.

UNITED STATES DESIGNATION

In connection with United States designation, this international patent application claims the benefit of priority under 35 U.S.C. 119(a) to Japanese Patent Application No. 2014-033970 filed on Feb. 25, 2014 whose disclosed contents are incorporated herein by reference.

What is claimed is:

1. A press brake comprising:

left and right side frames;

a lower table provided at a lower part of the left and right side frames;

an upper table facing the lower table and provided at an upper part of the left and right side frames; and strain detecting sensors provided on inside and outside surfaces of each of the left and right side frames for detecting strain of the left and right side frames, wherein the upper table and the lower table are configured to be vertically movable, left and right vertical drivers are provided at the left and right side frames, respectively, for vertically moving at least one of the upper table and the lower table, and when the left and right side frames are deflected horizontally, one of the strain detecting sensors detects an elongation of one of the left and right side frames, and another of the strain detecting sensors detects a contraction of the one of the left and right side frames such that a horizontal deflection amount is canceled and a vertical deflection amount is detected.

2. The press brake according to claim 1, wherein each of the strain detecting sensors includes:

a strain measuring plate having a strain measuring face; and a strain gauge biased against the strain measuring face of the strain measuring plate by a preset predetermined pressing force, and each of the strain measuring plates of each of the strain detecting sensors is securely attached to one of the inside and outside surfaces of one of the left and right side frames.

3. The press brake according to claim 1, wherein a controller configured to control the left and right vertical drivers based on the detected vertical deflection amount.

4. A press brake comprising:

left and right side frames;

a lower table provided at a lower part of the left and right side frames;

an upper table facing the lower table and provided at an upper part of the left and right side frames; and strain detecting sensors provided on inside and outside surfaces of each of the left and right side frames for detecting strain of the left and right side frames, wherein the upper table and the lower table are configured to be vertically movable, left and right vertical drivers are provided at the left and right side frames, respectively, for vertically moving at least one of the upper table and the lower table, the left and right side frames define a C-gap in a side view of the press brake, the strain detecting sensors are arranged in a vicinity of a position where a direction of a tangential line of the C-gap of the left and right side frames changes from a horizontal direction to a vertical direction, the strain detecting sensors are arranged to face each other on the inside and outside surfaces of each of the left and right side frames, and when the left and right side frames are deflected horizontally, one of the strain detecting sensors detects an elongation of one of the left and right side frames, and another of the strain detecting sensors detects a contraction of the one of the left and right side frames such that a horizontal deflection amount is canceled and a vertical deflection amount is detected.

5. A press brake comprising:

left and right side frames;

a lower table provided at a lower part of the left and right side frames;

an upper table facing the lower table and provided at an upper part of the left and right side frames;

strain detecting sensors provided on inside and outside surfaces of each of the left and right side frames for detecting strain of the left and right side frames; and a controller configured to control the left and right vertical drivers and that includes a calculator that computes an average of values detected by the strain detecting sensors provided on the inside and outside surfaces of each of the left and right side frames, wherein the upper table and the lower table are configured to be vertically movable, left and right vertical drivers are provided at the left and right side frames, respectively, for vertically moving at least one of the upper table and the lower table, and when the left and right side frames are deflected horizontally, one of the strain detecting sensors detects an elongation of one of the left and right side frames, and another of the strain detecting sensors detects a contraction of the one of the left and right side frames such that a horizontal deflection amount is canceled and a vertical deflection amount is detected.

* * * * *